US007766316B2

(12) United States Patent
Landwehr et al.

(10) Patent No.: US 7,766,316 B2
(45) Date of Patent: Aug. 3, 2010

(54) ROLL-ON AND STRIP-OFF APPARATUS FOR THE STACKED DEPOSITING OF SHEETS

(75) Inventors: Martin Landwehr, Paderborn (DE); Peter Heimann, Salzkotten (DE)

(73) Assignee: Wincor Nixdorf International GmbH (DE)

( * ) Notice: Subject to any disclaimer, the term of this patent is extended or adjusted under 35 U.S.C. 154(b) by 6 days.

(21) Appl. No.: 12/087,186

(22) PCT Filed: Jan. 16, 2007

(86) PCT No.: PCT/EP2007/050386

§ 371 (c)(1),
(2), (4) Date: Jan. 26, 2009

(87) PCT Pub. No.: WO2007/082884

PCT Pub. Date: Jul. 26, 2007

(65) Prior Publication Data

US 2009/0166951 A1 Jul. 2, 2009

(30) Foreign Application Priority Data

Jan. 20, 2006 (DE) ..... 10 2006 002 885

(51) Int. Cl.
*B65H 83/00* (2006.01)

(52) U.S. Cl. ..... 271/3.01; 271/3.08; 271/177; 271/207

(58) Field of Classification Search ..... 271/3.01, 271/3.08, 207, 177
See application file for complete search history.

(56) References Cited

U.S. PATENT DOCUMENTS

| | | | | |
|---|---|---|---|---|
| 5,116,037 | A | | 5/1992 | Gerlier et al. |
| 5,139,149 | A | * | 8/1992 | Gerlier ..... 209/534 |
| 2006/0119027 | A1 | | 6/2006 | Landwehr |

FOREIGN PATENT DOCUMENTS

| | | | |
|---|---|---|---|
| DE | EP 0 508 040 | A1 * | 10/1992 |
| DE | 103 31 018 | A1 | 2/2005 |
| EP | 0 508 040 | A1 | 10/1992 |

* cited by examiner

*Primary Examiner*—Patrick Mackey
*Assistant Examiner*—Gerald W McClain
(74) *Attorney, Agent, or Firm*—Harness, Dickey & Pierce, P.L.C.

(57) ABSTRACT

A device for arranging sheets in a stack that includes a surface for supporting the stack, one of the surface and the stack define a stack face. The device includes an adjustment unit, a rotatable shaft, a first roller, a second roller, a strip-off wheel, and a center roller. The strip-off wheel is fixedly mounted to the rotatable shaft such that the strip-off wheel rotates with the shaft. The strip-off wheel includes a plurality of teeth that are operable to contact the stack face such that rotation of the strip-off wheel pulls a first sheet from the stack. The center roller is between the first roller and the second roller. The center roller is operable to transport the first sheet pulled from the stack to a transfer device and to receive a second sheet from the transfer device and transfer the second sheet to an end of the stack face.

20 Claims, 9 Drawing Sheets

ROLL-ON AND STRIP-OFF APPARATUS FOR THE STACKED DEPOSITING OF SHEETS

CROSS-REFERENCE TO RELATED APPLICATIONS

Figure 1:
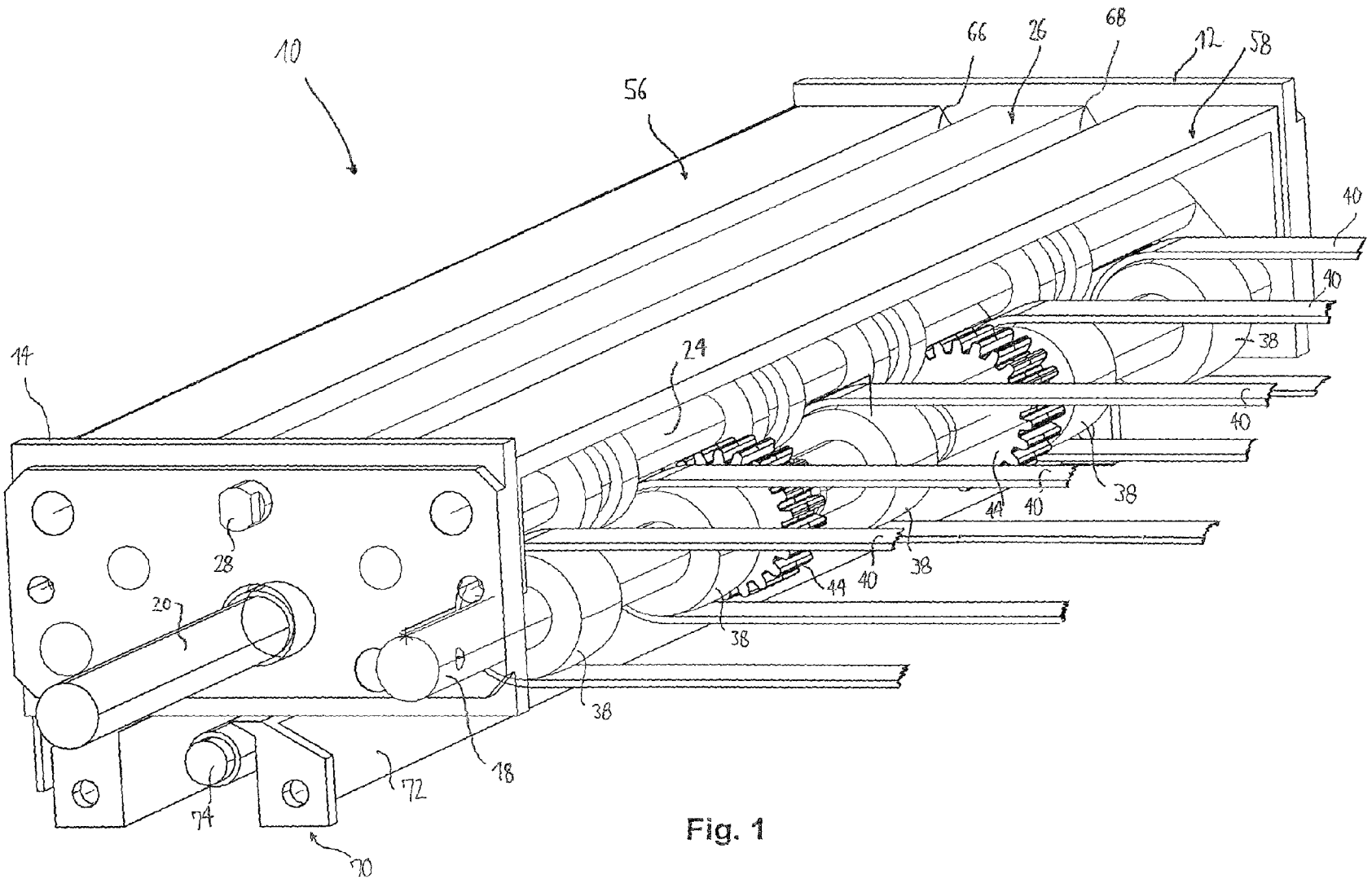

This application is a 371 U.S. National Stage Application of International Application No. PCT/EP2007/050386, filed Jan. 16, 2007 and published in German as WO 2007/082884 on Jul. 26, 2007. This application claims the benefit of DE 10 2006 002 885.6, filed Jan. 20, 2006. The disclosures of the above applications are incorporated herein by reference.

The present invention relates to a device for the stacked depositing of sheets, specifically [vouchers] such as bank notes or check forms in accordance with the preamble of claim 1, such as are used specifically for cartridges/cassettes in automated money and check deposit machines.

A device of this kind for depositing sheets is known from DE 103 31 018 A1. It comprises at least two carrying faces for depositing one stack of sheets each and a rolling apparatus to create the stack of sheets.

The rolling apparatus comprises a unit which can be moved along the two stacks of sheets having a first roller and a second roller which are located adjacent each other and around each of which a belt is led.

The belts are supported at their one end in a storage roller having a winding shaft and at their other end are articulated to an attachment point. The two stacks of sheets are each pressed from below against the first and second belts so that the stacks of sheets are held securely. The rolling device takes a sheet to be deposited from a transfer device and takes it with its edge to one end of the stack face. The sheet thus taken is then rolled onto the specific stack face by the rolling device, wherein the rolling device is moved to the specific stack of sheets by the rolling and unrolling action of the two belts.

A known device of this type is especially suited to for the stacked depositing of banks notes in a cash drawer of money deposit automats. It operates reliably, relatively quickly and is also economical of space so that it can be housed easily in cash drawers. However, when the drawer is full, it has to be emptied by an authorized person, which involves cost and effort, because the deposit unit has to be taken out of operation at this time.

A dispensing unit is known further from DE 101 01 565 C1 for dispensing sheets comprising a box-shaped container to receive a stack of sheets which can be moved with a stack end face towards a front end of the container, a module to receive the container and a stripping device for removing individual sheets from the stack end face through a delivery opening in the container. The stripping device has a specific strip-off roller which can be driven to abut the stack end face, a transport roller disposed parallel to said strip-off roller which can be driven in the same direction and a counter-roller assigned to said transport roller which can be driven in the opposite direction which, with the transport roller, forms a roller slot, with the strip-off roller located inside the container.

The object of the invention is to further refine the device of the type described initially such that it permits both the stacked depositing of sheets and the removal of a sheet from the stack, thus reducing the operating and maintenance costs of a unit in which the device is used. In particular, it should be possible to use the device in the limited confines of cash drawers.

This object is achieved in a device of the type described initially by arranging a center roller and at least one guide element between the first and second roller and additional strip-off means to remove one sheet from the stack face in accordance with the descriptive part of claim 1. The location of a center roller creates a transport device which is suitable both for transporting the stripped-off sheet to a transfer device and for accepting the sheet from the transfer device and stacking it.

The rolling and stripping apparatus is suitable both for rolling sheets onto a sheet stack and for isolating sheets from a sheet stack, creating a very compact unit and allowing it to be used in cassettes with tight installation space. The device in accordance with the invention for stacking sheets and removing said sheets can be used, for example, in the operating cycle of a unit for depositing and dispensing money in which bills deposited are stacked and notes to be dispensed are pulled from the stack face. If approximately as many notes are issued as are deposited, the cash box needs to be emptied only very infrequently, which reduces operating costs.

Preferably the means for withdrawing one sheet comprises at least a strip-off wheel which contacts the stack surface with its circumference such that, as a result of its rotation, one sheet is pulled from the stack of sheets. The strip-off wheel consists advantageously of a rubber-like material and is provided on its circumference with nubs in order to achieve high adhesive friction with the sheet to be pulled off. Preferably the second roller and the at least one strip-off wheel are carried jointly on a second shaft. The second roller is preferably free to rotate and the strip-off wheel is assembled rotation-free on the second shaft. As a result of this arrangement, the individualizing function and the roll-on function can be combined simply and in a manner that saves space.

Preferably in the area of the first end of the adjustment path, a ramp element with a rising flank is located in such a manner that a sheet pulled off by the strip-off means is pushed up the ramp with its forward end. Preferably the device comprises at least one counter roller whose circumferential surface extends from below into the plane of the flank of the ramp element and which can be driven such that it brakes a sheet being pushed up the ramp. The function of the counter roller consists of preventing double strip-offs.

Preferably the device further comprises pressure means to press sheets against the counter roller. This amplifies the braking effect of the counter roller. In an advantageous refinement, the pressure means are formed by at least one spring, specifically an arcuate spring plate which is located on a rotatable carrier such that said spring is moved towards or away from said counter roller as a result of the rotation of the carrier. By suitable rotation of the carrier, the pressure force can be generated at precisely the moment when it is needed. If, however, the braking effect of the counter roller is not desired, said effect can be almost entirely canceled by swinging the spring away, as will be explained below in more detail using an embodiment of the invention.

The center roller of the rolling and strip-off devices forms a central element for further transporting a pulled-off sheet. The center roller is located between the first and the second roller, and the sheet is transported along its circumferential surface. The center roller can preferably be driven in both directions, and the center roller and the second roller can preferably be coupled such that they rotate in the same direction as the result of a common drive.

Furthermore, the center roller also forms a central element for the deposit of a sheet on the stack face. One sheet is taken from the transfer device around the circumferential surface of the center roller to the stack face. Transporting the sheet is the requirement for being able to roll the sheet in a known way on the stack face.

The center roller acts both to transport the sheet to the stack face and to roll the sheet on the stack face. This is because the rotational direction of the center roller suitable for the transportation of the sheet coincides with the directions of rotation of the first and second rollers. This represents a substantial advantage, for example, compared with the rolling apparatus from the aforementioned DE 103 31 018 A1 which is formed by a vertical belt transportation. Since, with belt transportation, the oppositely located belt rollers always rotate in the opposite direction, one of them is always rotating counter to the roll-on direction. This roller, or the belt transported thereon, should not come into contact with the stack face because the topmost sheet on the stack face could be jammed by friction against the belt. In contrast, the center roller in accordance with the invention serves both to transport the sheet to the stacking surface and to roll the sheet onto the stack face.

In an advantageous refinement, guide plates are provided on both sides of the center roll to conduct a sheet so that a sheet can be deposited both from the left and from the right side onto the stack face. This makes it possible to deposit sheets alternately from both direction onto the stack face. This can double the speed of deposit.

In this respect, the refinement of the present invention goes in the opposite direction to the aforementioned DE 103 31 018 A1 with two transfer devices at the ends of the adjustment path. While only one transfer device was provided in the latter case to deposit one sheet selectively on one of several carrier surfaces, two transfer devices are provided here to deposit sheets from both directions on only one carrier surface, depositing twice the number of sheets overall in the same time as a result.

The transportation device is preferably set up to transport the sheet at a transportation speed which is the same as the adjustment speed of the adjustable unit along the adjustment track. In this the transportation device differs from those transportation devices which include the first or the second belt as part of a belt transport and whose transportation speed is naturally only one half of the adjustment speed of the adjustable unit along the adjustment path.

Additional advantageous embodiments of the invention are cited in the dependent claims.

Additional advantages and features of the present invention can be found in the following description in which the invention is explained using an embodiment with reference to the attached drawings.

Figure 2:
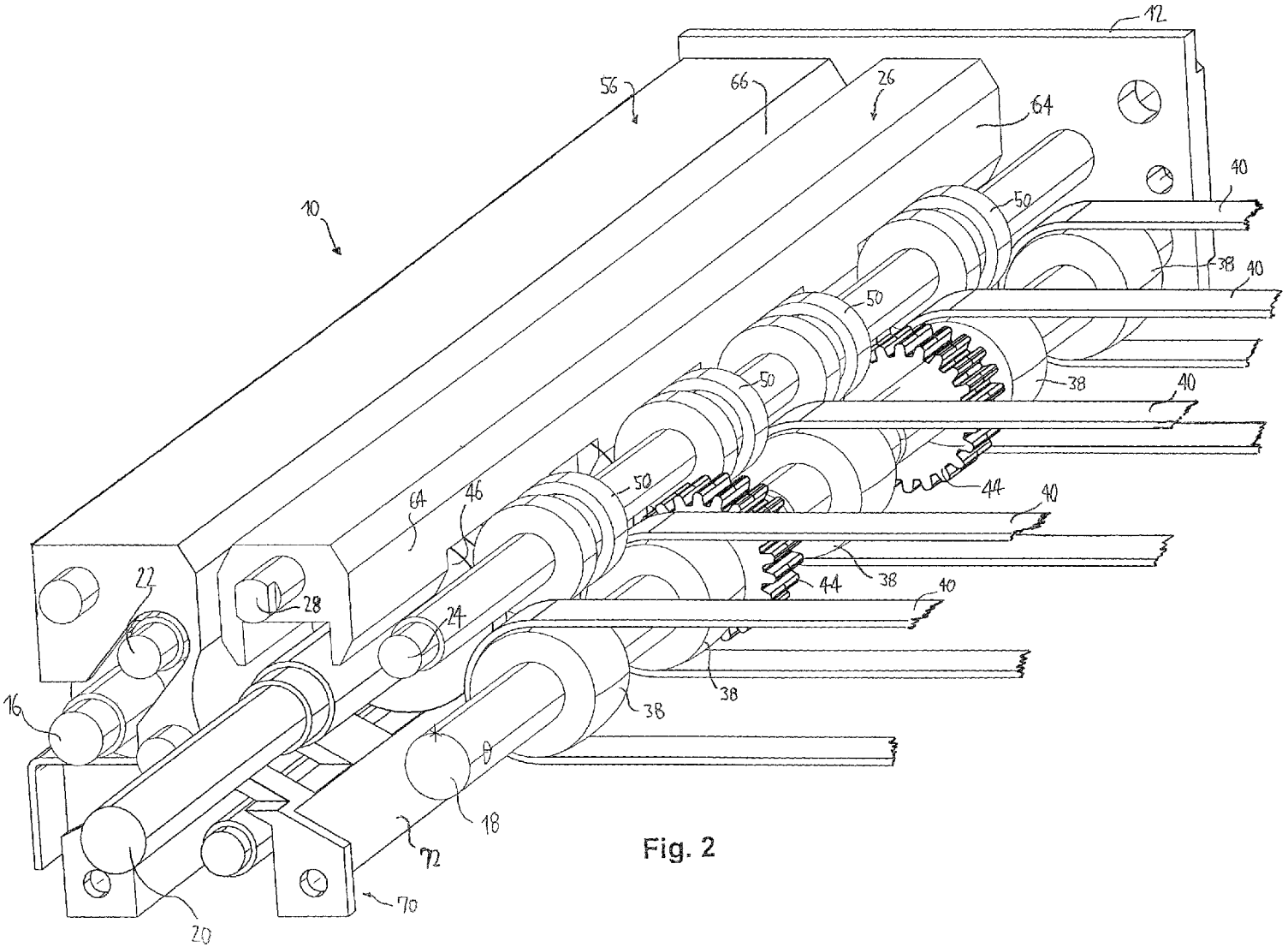
Figure 3:
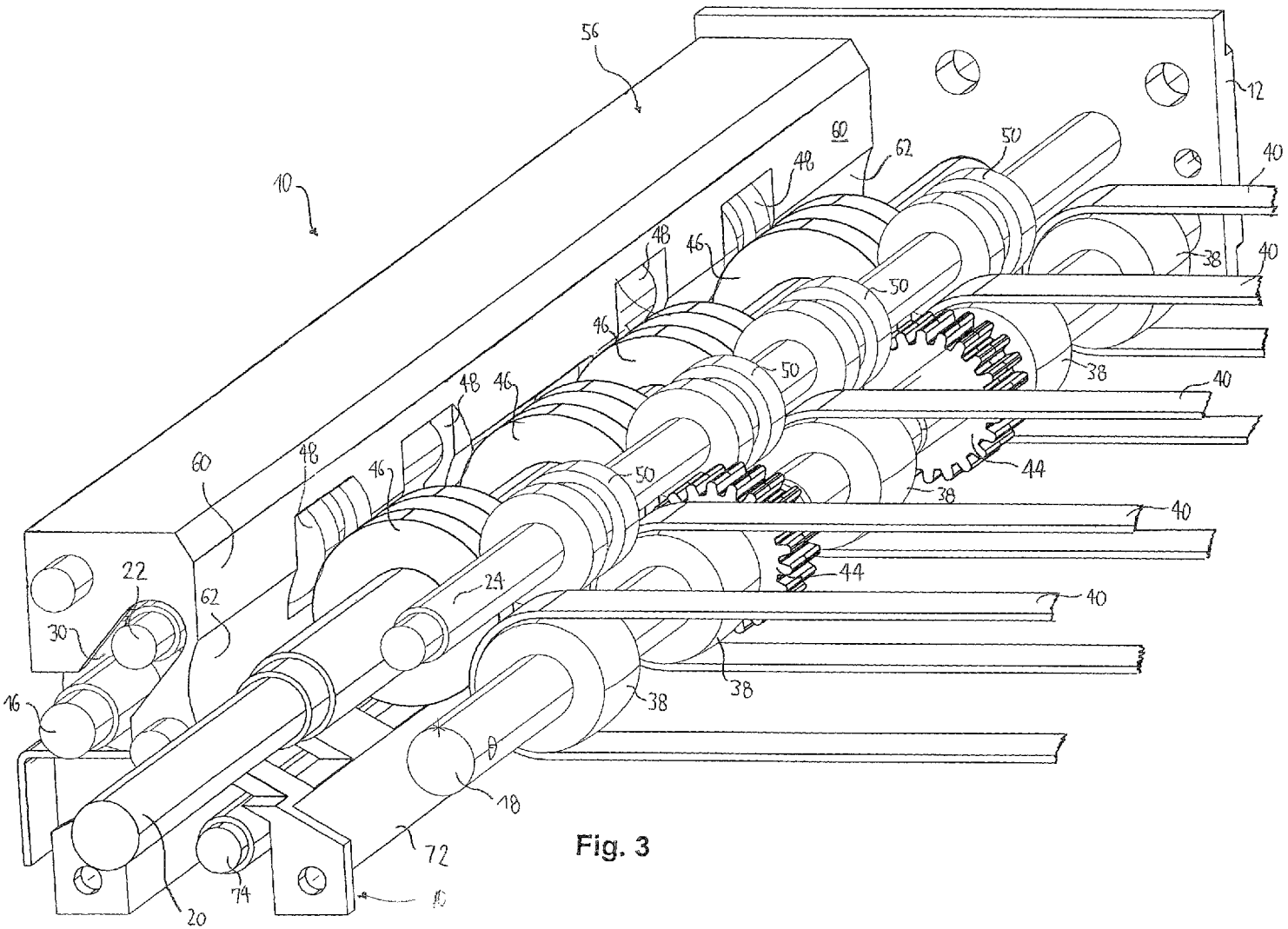
Figure 4:
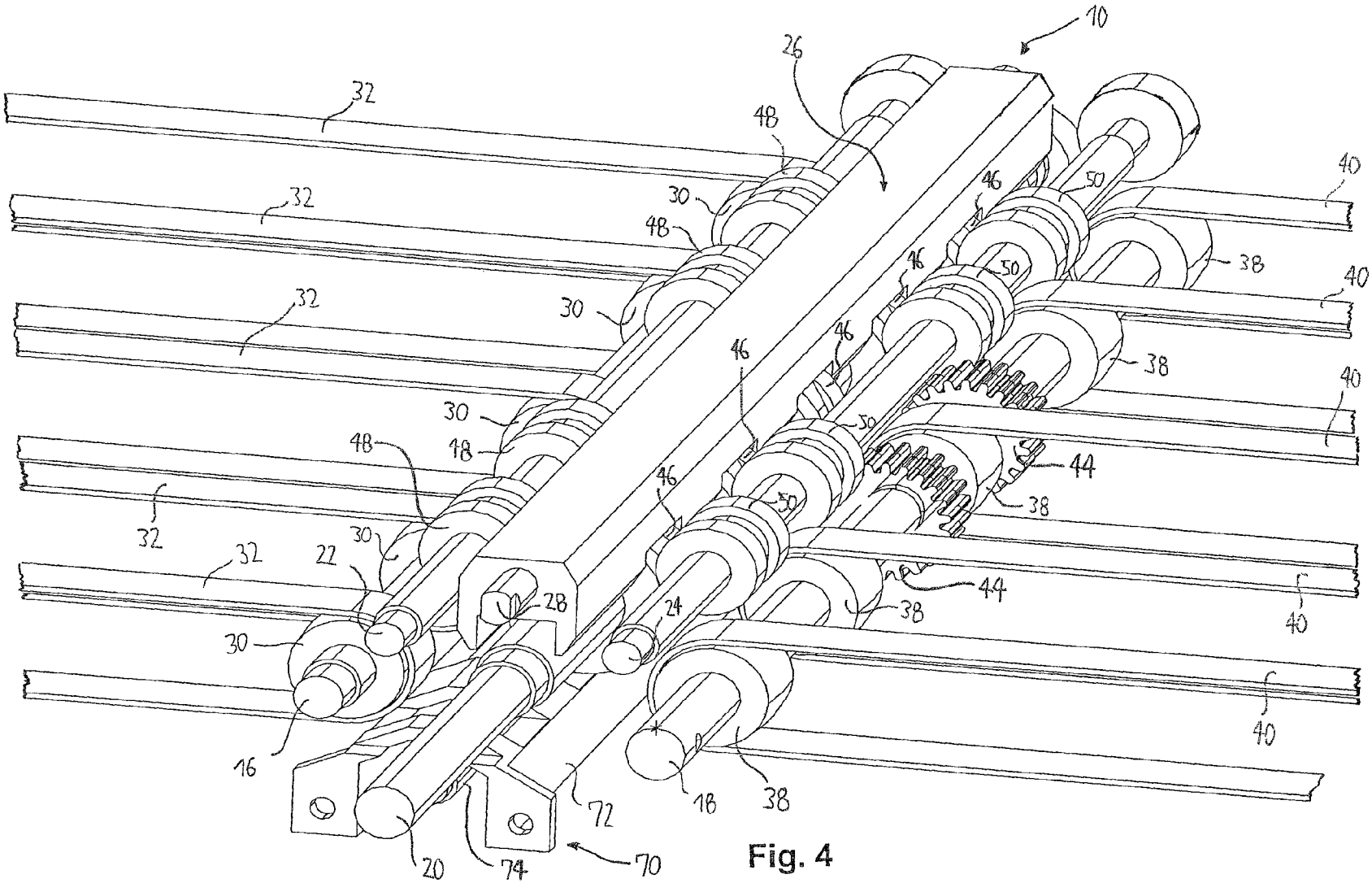
Figure 5:
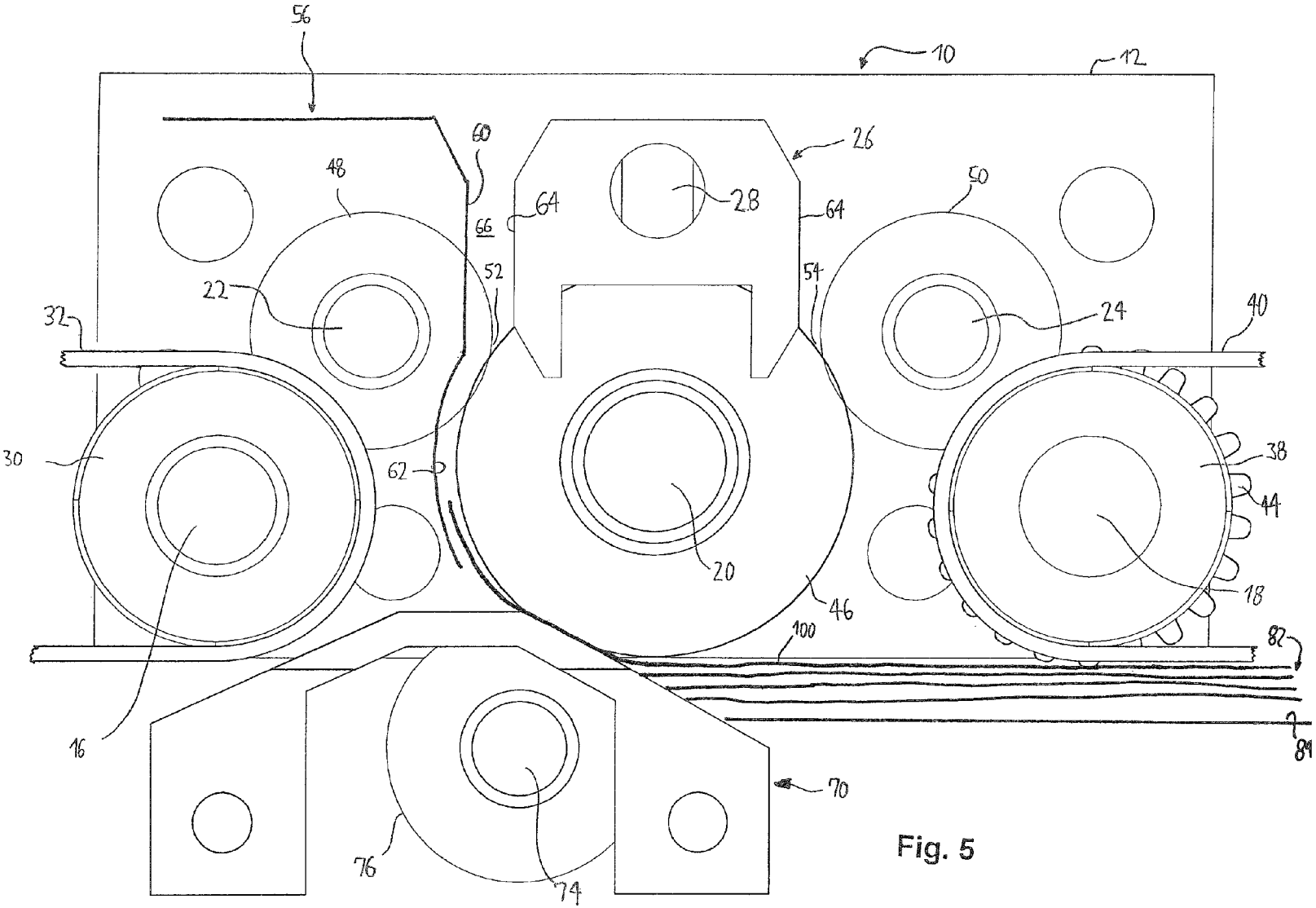
Figure 6:
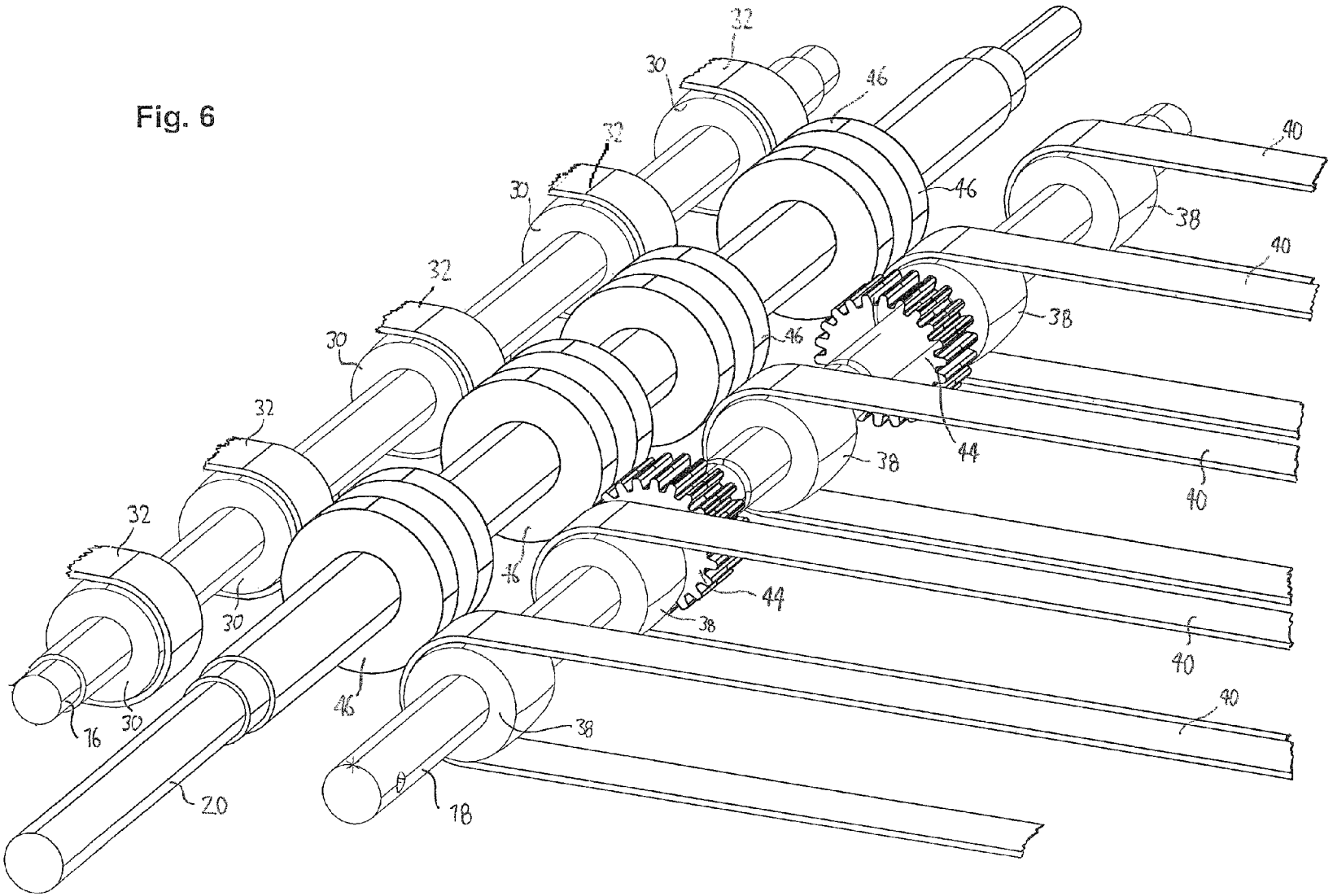
Figure 7:
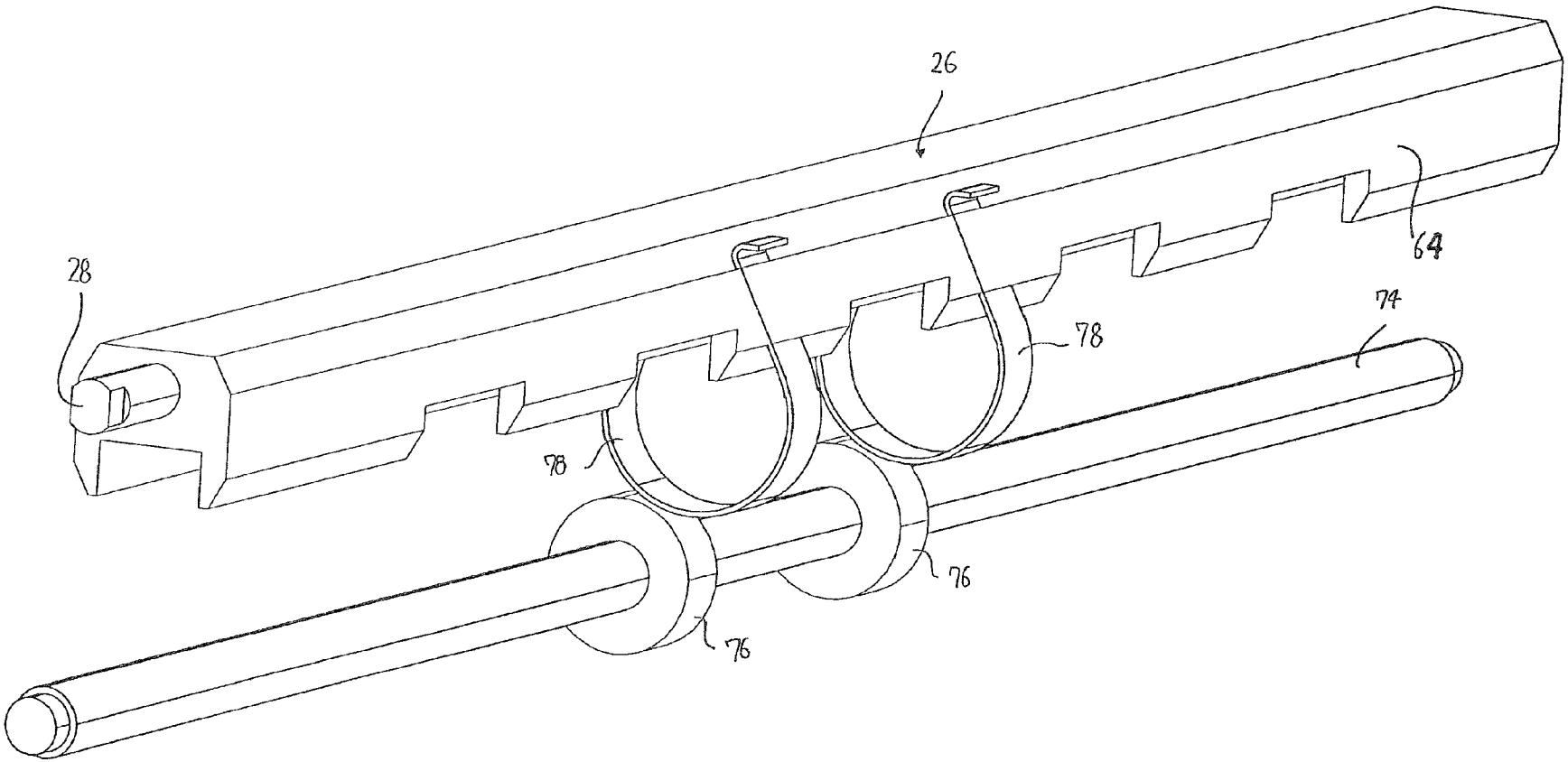

FIG. 1 shows a perspective view of a device for the stacked depositing of sheets in accordance with the invention, FIG. 2 shows a perspective view of the device from FIG. 1 without a front side section and a second guide element, FIG. 3 shows a perspective view of the device from FIGS. 1 and 2 without a carrier for the arcuate spring plate, FIG. 4 a perspective view of the device from FIGS. 1 to 3 without both side parts and both guide elements, FIG. 5 shows a side view of the essential elements of the device from FIG. 1, FIG. 6 shows a perspective view of a first shaft, a second shaft and a center shaft with the elements mounted thereon, FIG. 7 shows a perspective view of a fifth shaft, the arcuate spring sheets and their carriers, and FIGS. 8 to 11 show different views of the device during the roll-on process of a sheet in a schematic side view.

FIGS. 1 to 4 show perspective views of a device for the stacked depositing of sheets, where different parts have been omitted in the different illustrations to reveal the view of the parts lying behind. FIG. 5 shows a side view of the essential components of the device from FIGS. 1 to 4.

The device comprises an adjustable unit 10 with a rear side part 12 and a front side part 14. A first shaft 16, a second shaft 18, a center shaft 20, a third shaft 22, a fourth shaft 24 and a carrier 26, which can be rotated about a shaft 28, are carried between the side parts 12 and 14.

Five first rollers 30 are carried freely rotatable on the first shaft 16 (refer specifically to FIG. 4, FIG. 5 and FIG. 6). Around each of the first rollers 30 a first belt 32 is placed and taken parallel to a stack face 34 (refer to FIGS. 8 to 11) to a first attachment point 36 in the area of a first end of an adjustment track along which the adjustable unit 10 can be adjusted (refer to FIGS. 8 to 11).

In a similar way, five additional rollers 38 are carried free to rotate on the second shaft 18. Around each of the second rollers 38, a second belt 40 is placed and taken parallel to the stack face 34 to a second attachment point 42 in the area of a second end of the adjustment track of the adjustable unit 10 to which said belt is attached (refer to FIGS. 8 to 11). The second end of the belts 32, 40, not shown here, is attached in a storage roller 92 so that by rolling up and unrolling the belts 32, 40 the unit 10 can be adjusted overall. In addition, on the second shaft 18 two strip-off wheels 44 are carried fixed in terms of rotation. The strip-off wheels 44 are pinion-shaped and may consist, for example, of rubber.

On the center shaft 20, four center rollers 46 are installed fixed in terms of rotation which can best be seen in FIG. 3, FIG. 5 and FIG. 6. On the third shaft 22, or the fourth shaft 24, four first pressure rollers 48, or four second pressure rollers 50, are located, each lying opposite one of the center rollers 46 and forming a first roller gap 52, or a second roller gap 54 with said shaft (refer to FIG. 5).

The adjustable unit 10 comprises further a first guide element 56 and a second guide element 58 (refer to FIG. 1). The first and the second guide element 56, 58 each has an essentially straight section 60 (refer to FIG. 3 and FIG. 5) and a curved section 62 which runs parallel to the circumferential surface of the center roller 46. The carrier 26 is configured essentially straight on both sides, identified as section 64. Between the vertical section 60 of the first guide element 56 and the facing vertical section 64 of the carrier 26, a first transport slot 66 is formed which meets the center roller 46 vertically. A second transport slot 68, which meets the other side of the center roller 46 vertically, is formed in a similar way between the vertical section 60 of the second guide element 58 and the vertical section 64 of the carrier 26 facing it (refer to FIG. 1, for example).

The device further comprises a ramp element 70 which is located fixed in the area of the first end of the adjustment path in a housing, for example in a banknote box (not shown). The ramp element 70 has a rising flank 72 (refer to FIGS. 1 to 4). The device further comprises a non-adjustable shaft 74 on which two counter rollers 76 are located (refer to FIG. 5, for example). The shaft 74 with the two counter rollers 76 is shown separately in FIG. 7 in a perspective view. As is also shown in FIG. 7, two arcuate spring plates are attached to the carrier 26. By rotating the carrier 26 about its shaft 28, the arcuate spring plates 78 are moved towards the counter roller 76 lying opposite them or away from said counter roller. The function of the spring plates 78 is to exert pressure on sheets which are located between the counter roller 76 and the spring plates 78.

In what follows, the function of the device described using FIGS. 1 to 7 is described with reference to FIGS. 8 to 11.

FIGS. 8 to 11 show snapshots of the adjustable unit 10 when it rolls a sheet 80 onto the stack face 34 which is formed by the surface of the topmost sheet of a stack 82. A schematic side view is shown in each case in which the present directions of rotation of the rollers are indicated by arrows.

Figure 8:
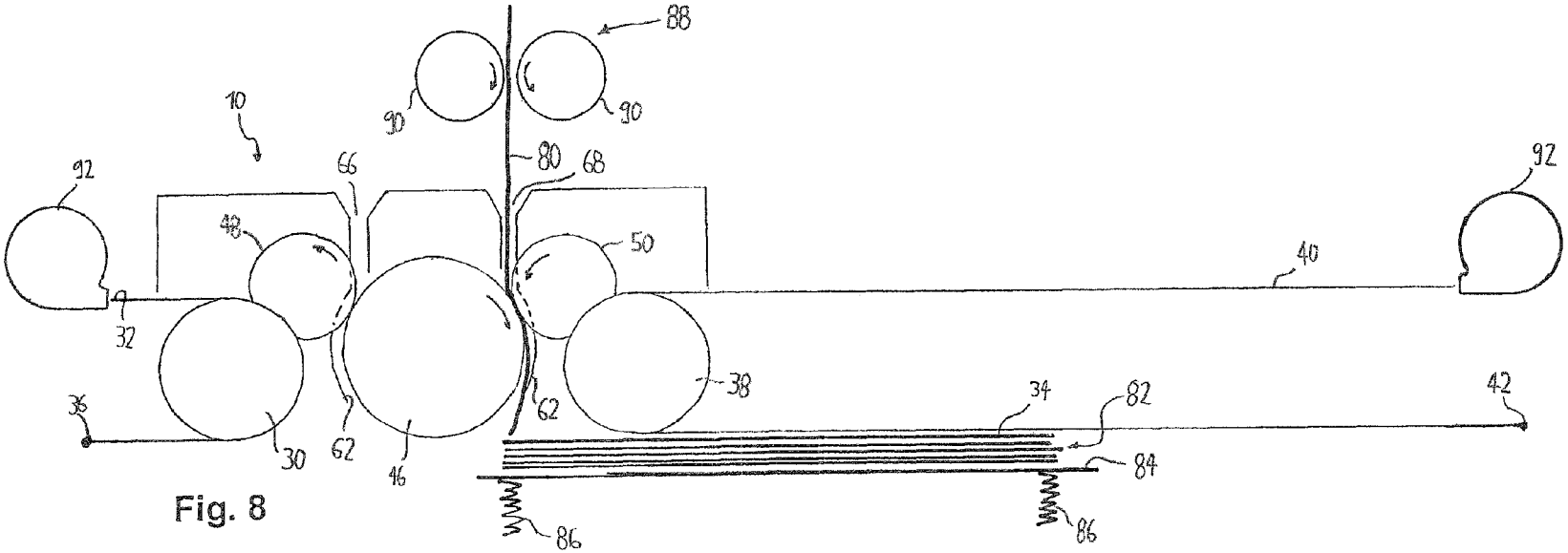
Figure 9:
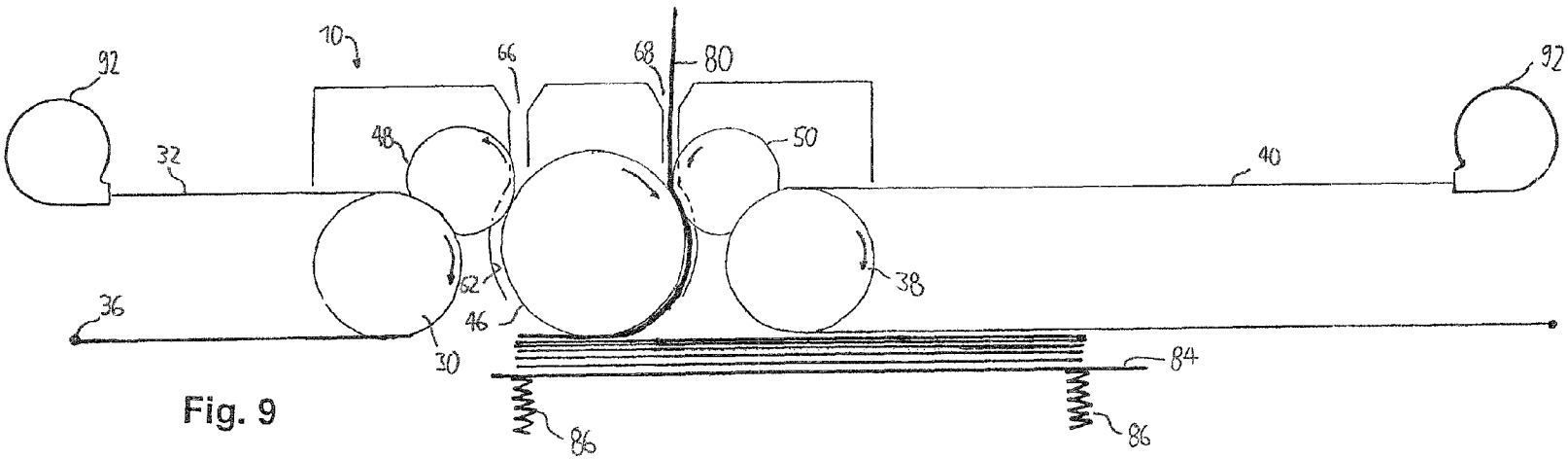

In the illustration in FIG. 8, the adjustable unit 10 is at rest at the first end of the adjustment track, i.e. the first and second shaft 30, 38 are not rotating. In this position, the sheet stack 82 is held by the second belt 40 since it is on a carrying surface 84 which is being pressed against the second belt 40 from below by springs 86. The sheet to be rolled on is taken vertically downwards into the second transport slot 68 by a first sheet transfer device 88, indicated schematically in FIG. 8 by two transport rollers 90 lying opposite one another.

At the time shown, the leading end of the sheet 80 has already passed the roller gap 54 (refer to FIG. 5) which is formed between the center roller 46 and the second pressure roller 50. The center roller 46 is driven clockwise. The sheet 80 is caught in the roller gap 54 between the center roller 46 and the second pressure roller 50 and moved along the circumferential surface of the center roller 46. The sheet 80 is guided by the section 62 of the second guide element 58 which is located parallel to the circumference of the center roller 46. Only the center roller 46 is driven until the leading edge of the sheet reaches the first end of the stack face 34 (refer to FIG. 8). The center roller 46, the second pressure roller 50, the concave section 62 of the second guide element 58 and the second vertical transport slot 68 form one half of the transport device of the adjustable unit 10 mentioned initially.

Note that the section 62 of the second guide element 58 extends downward far enough that it lies opposite one section on the lower half of the center roller 46. In this way, the sheet 80 is bent suitably to be rolled onto the stack face 34.

After the sheet 80 has reached the first end of the stack face 34 with its leading edge, the movement of the adjustable unit 10 towards the second end of the adjustment track, i.e. to the right, is started by rolling the second belt 40 up on a storage roll 92 and unrolling the first belt 32 from a storage roll 92. The sheet is initially rolled by the center roller 46 onto the stack face 34 (refer to FIG. 9). At this time, the sheet stack 82 is held by the second belt 40 and the center roller 46.

Figure 10:
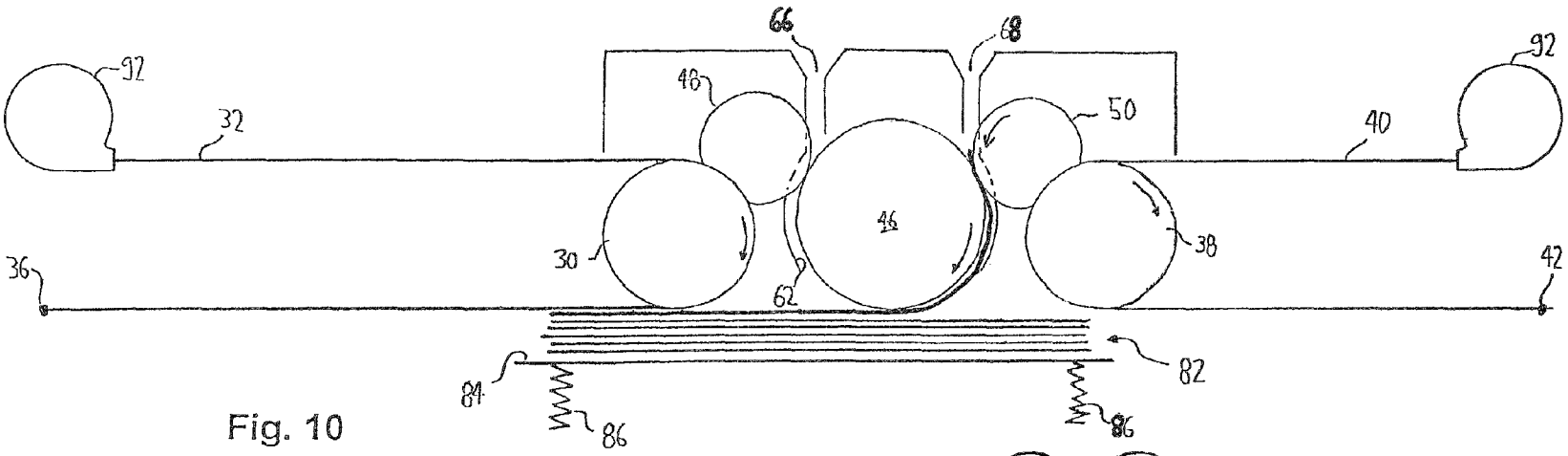

FIG. 10 shows a snapshot at an even later time. At the time of FIG. 10, the sheet 80 has been rolled almost completely onto the stack face 34. The sheet stack 82 is now held by the first belt 32 and the center roller 46. Note that when rolling on, the center roller 46 rotates in the same direction as the first roller 30 and the second roller 38. Consequently, the center roller 46 is not only involved in transporting the sheet 80 to the stack face 34 but also in the rolling on process.

Figure 11:
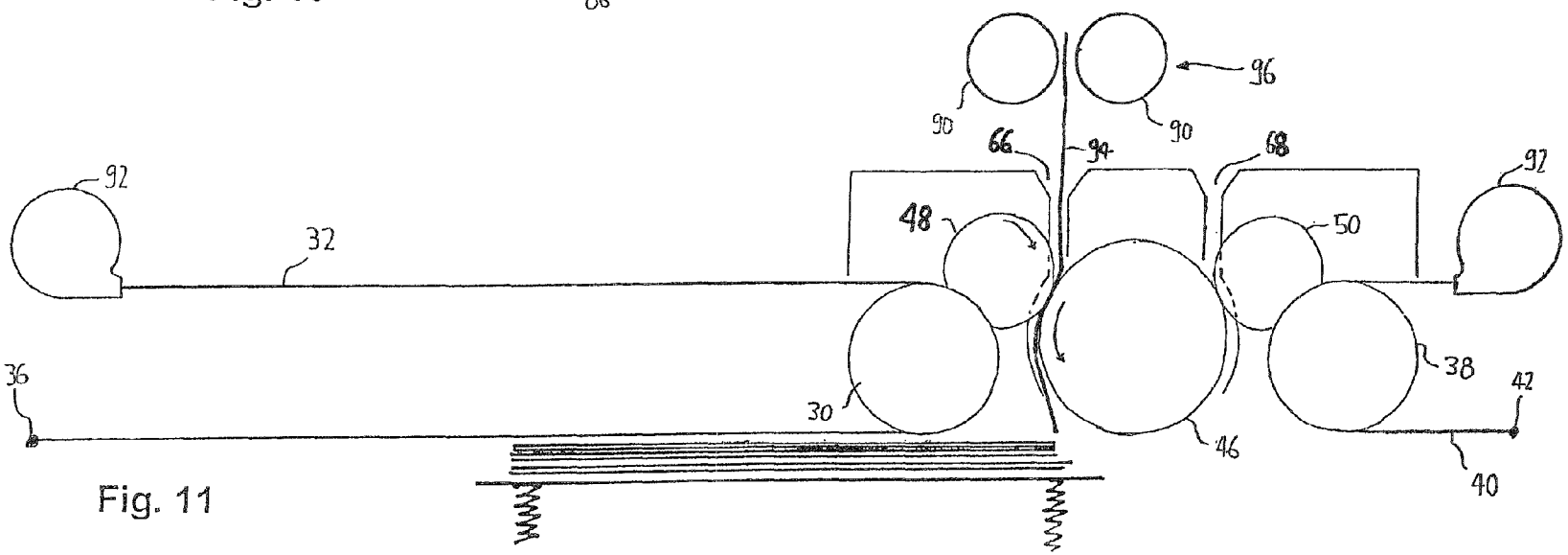

In the snapshot from FIG. 11, the adjustable unit 10 has reached the second end of the adjustment track. At this time, the sheet stack 82 is held by the first belt 32. In this position, an additional sheet 94 from a second transfer device 96, which is shown schematically by two oppositely located transport rollers 98, can be fed into the first vertical transport slot 66 and, with the aid of the center roller 46, the first pressure roller 48, the concave section 62 of the first guide element 56 and of the first vertical transport slot 66, which jointly form the other half of the transport device mentioned initially, transported to the stack face 34. When the adjustable unit 10 returns in the direction of the first end of the adjustment track, the sheet 94 is rolled on the stack face 34 in a similar way as in conjunction with FIGS. 8 to 10.

The device shown is thus suitable for depositing one sheet as the adjustable unit 10 moves back and forth, i.e. stacking in both directions. In this the device differs from known devices of the type mentioned initially in which the adjustable unit has to be returned regularly to a starting position prior to each new deposit of a sheet. The efficiency in depositing can be essentially doubled, which however requires a second transfer device 96 and a switch (not shown) where a transport path divides to take sheets alternately to the first transfer device 88 and the second transfer device 96.

In what follows, with reference to FIG. 5, the isolating function of the device is described. In the illustration of FIG. 5, the adjustable unit 10 is at the first end of the adjustment track. In FIG. 5, the carrying surface 84 is also drawn in on which a sheet stack 82 is lying. For isolation purposes, the center shaft 20 with the center rollers 46 fixed with respect to rotation and the second shaft 18 with the strip-off wheels 44 fixed with respect to rotation are rotated clockwise in the illustration from FIG. 5. The shafts 18 and 20 can preferably be coupled mechanically so that only the shaft 20 has to be driven. Through the rotation of the strip-off wheels 44, the topmost sheet 100 of the sheet stack 82 in the illustration from FIG. 5 is pushed to the left and up the flank 72 of the ramp element 70 with a leading edge until it is gripped by the center roller 46 and is likewise pushed by said roller. The leading edge of the sheet 100 is guided along the side of the circumferential surface of the center roller 46 facing the first end of the adjustment track through the concave section 62 of the first guide element 56. This moment is shown in FIG. 5.

By further shifting of the strip-off wheels 44, the leading end of the sheet 100 arrives at the roller gap 52 between the first pressure roller 48 and the center roller 46. The sheet 100 is picked up in this roller gap 52 again and taken by the clockwise rotation of the center roller 46 through the first vertical transport slot 66 upwards out of the adjustable unit 10. A receiving device (not shown) may be located above the first vertical transport slot 66 which receives and passes on the sheet 100. The receiving device can be formed specifically by the first transfer device 88 which in this case is operated in the opposite direction than is the case in the transfer of a sheet to the adjustable until 10.

In order to prevent double pick-ups, the counter-roller 76 rotates continuously at a slow speed in a clockwise direction as the sheet 100 is pulled from the sheet stack. A sheet which was pushed to the left by the pull-off wheel 44 together with the topmost sheet 100, comes into contact with the counter-roller 76 and is stopped by said roller. The topmost sheet 100, on the other hand, slides over the sheet that was stopped and is taken as described above from the adjustable unit 10. The braking effect of the counter-roller 76 is reinforced by the arcuate spring plate 78 (refer to FIG. 7, not shown in FIG. 5) being pivoted by the clockwise rotation of the carrier 26 around the shaft 28, as shown in FIG. 5, onto the counter-roller 76, and consequently the sheets which come into contact with the counter-roller 76, are pressed against said roller, thus increasing the braking effect of the counter-roller 78.

What is claimed is:

1. A device for arranging sheets in a stack, the device includes a surface for supporting the stack, at least one of the surface and the stack define a stack face, the device comprising:

an adjustment unit movable along an adjustment track parallel to the stack face;

a rotatable shaft mounted to the adjustment unit;

a first roller rotationally mounted at the adjustment unit, the first roller has a first belt mounted thereto;

a second roller mounted to the rotatable shaft such that the second roller is free to rotate about the shaft, the second roller has a second belt mounted thereto, the stack face is continuously pressed against at least one of the first roller and the second roller;

a strip-off wheel fixedly mounted to the rotatable shaft such that the strip-off wheel rotates with the rotatable shaft, the strip-off wheel includes a plurality of teeth that are operable to contact the stack face such that rotation of the strip-off wheel pulls a first sheet from the sheet stack; and a center roller between the first roller and the second roller, the center roller is operable to be driven to transport the first sheet pulled from the stack to a transfer device and to receive a second sheet from the transfer device and transfer the second sheet to an end of the stack face.

2. The device of claim 1, further comprising a ramp including a flank rising toward a first end of the adjustment track, the ramp is operable to be positioned proximate to the first end such that a third sheet removed from the stack of sheets by the strip-off wheel in the direction of the first end is pushed up the flank.

3. The device of claim 2, wherein the ramp includes a counter-roller having an outer surface that extends into a plane of the flank of the ramp, the counter-roller is operable to be driven to brake a sheet pushed up the flank.

4. The device of claim 3, further comprising a pressure means operable to press the stack again the counter-roller.

5. A device for arranging sheets in a stack, the device includes a surface for supporting the stack, at least one of the surface and the stack define a stack face, the device comprising:

an adjustment unit movable along an adjustment track parallel to the stack face;

a rotatable shaft mounted to the adjustment unit;

a first roller rotationally mounted at the adjustment unit, the first roller has a first belt mounted thereto;

a second roller mounted to the rotatable shaft such that the second roller is free to rotate about the shaft, the second roller has a second belt mounted thereto, the stack face is continuously pressed against at least one of the first roller and the second roller;

a center roller between the first roller and the second roller, the center roller is operable to be driven to transport the first sheet pulled from the stack to a transfer device and to receive a second sheet from the transfer device and transfer the second sheet to an end of the stack face;

a first pressure roller between the first roller and the center roller, the first pressure roller and the center roller define a first roller slot therebetween;

a second pressure roller between the second roller and the center roller, the second pressure roller and the center roller define a second roller slot therebetween; and a strip-off wheel fixedly mounted to the rotatable shaft such that the strip-off wheel rotates with the rotatable shaft, the strip-off wheel is operable to contact the stack face such that rotation of the strip-off wheel pulls the first sheet from the sheet stack;

wherein rotation of the center roller against the first pressure roller is operable to transport the first sheet through the first roller slot; and wherein rotation of the center roller against the second pressure roller is operable to transport the second sheet through the second roller slot.

6. The device of claim 5, wherein the strip-off wheel includes a plurality of teeth extending from an outer surface of the strip-off wheel.

7. The device of claim 5, further comprising a ramp including a flank rising toward the first end of the adjustment track, the ramp is operable to be positioned proximate to the first end such that a third sheet removed from the stack of sheets by the strip-off sheet in the direction of the first end is pushed up the flank.

8. The device of claim 7, wherein the ramp includes at least one counter-roller having an outer surface that extends into a plane of the flank of the ramp, the counter-roller is operable to be driven to brake a sheet pushed up the flank.

9. The device of claim 5, further comprising a first guide element including a first concave section on a first side of the center roller and a second guide element including a second concave section on a second side of the center roller that is opposite to the first side.

10. The device of claim 5, wherein the center roller has a transfer speed that is about the same as a transport speed of the adjustment unit along the adjustment track and the center roller rotates in the same direction as the first roller and the second roller when rolling up a sheet.

11. A device for arranging sheets in a stack, the device includes a surface for supporting the stack, at least one of the surface and the stack define a stack face, and a movable unit operable to move along an adjustment track parallel to the stack face, the device comprises:

a first roller and a second roller that are located next to each other at the movable unit, wherein at least one first belt is taken around the first roller and parallel to the stack face to a first attachment point in an area of a first end of the adjustment track, wherein at least one second belt is taken around the second roller and parallel to the stack face to a second attachment point, and wherein the stack face is continuously pressed against at least one of the first and the second roller;

at least one strip-off wheel having an outer surface that contacts the stack face such that rotation of the strip-off wheel pulls a first sheet from the sheet stack;

at least one center roller between the first roller and the second roller operable to be driven to transport the first sheet that has been pulled from the stack to a transfer device and to receive a second sheet from the transfer device and transfer the second sheet to an end of the stack face;

a rotatable shaft with the second roller and the strip-off wheel mounted thereto, the strip-off wheel is fixedly mounted on the shaft; and a ramp element including a flank rising toward the first end of the adjustment track, the ramp element is operable to be positioned proximate to the first end such that a third sheet removed from the stack of sheets by the strip-off wheel in the direction of the first end is pushed up the flank.

12. The device of claim 11, wherein the ramp element includes at least one counter-roller having an outer surface that extends into a plane of the flank of the ramp element, the counter-roller is operable to be driven to brake a sheet being pushed up the flank.

13. The device of claim 12, further comprising a pressure means operable to press the stack against the counter-roller.

14. The device of claim 13, wherein the pressure means includes an arcuate spring sheet located on a rotatable carrier.

15. The device of claim 11, wherein the center roller is operable to be driven in opposite directions.

16. The device of claim 15, wherein the center roller and the second shaft are operable to be driven with a common drive in a common direction.

17. The device of claim 11, further comprising a first guide element on a first side of the center roller and a second guide element on a second side of the center roller that is opposite to the first side.

18. The device of claim 11, wherein the center roller has a transfer speed that is about the same as a transport speed of the movable unit along the adjustment track and the center roller rotates in the same direction as the first and the second roller when rolling up a sheet.

19. The device of claim 11, further comprising a pressure roller and a roller slot between the pressure roller and the center roller in which the sheet is held and transported by rotation of the pressure roller and the center roller.

20. The device of claim 19, wherein one side of the roller slot is defined by a concave section of a first guide element.

* * * * *